US006435752B1

(12) United States Patent
Chang

(10) Patent No.: US 6,435,752 B1
(45) Date of Patent: Aug. 20, 2002

(54) CORRECTION PEN WITH PRESSURE ADJUSTING STRUCTURE

(76) Inventor: Han-Chiang Chang, 2F, No. 61, Sec. 1, Cheng Kung Rd., Nan Kang District, Taipei (TW)

( * ) Notice: Subject to any disclaimer, the term of this patent is extended or adjusted under 35 U.S.C. 154(b) by 0 days.

(21) Appl. No.: 09/956,109

(22) Filed: Sep. 20, 2001

(51) Int. Cl.[7] ..... B43K 5/18
(52) U.S. Cl. ..... 401/242; 401/243
(58) Field of Search ..... 401/242, 187, 401/188 A, 243, 245, 246

(56) References Cited

U.S. PATENT DOCUMENTS 5,542,771 A * 8/1996 Masumoto ..... 401/188 A
5,716,151 A * 2/1998 Satake ..... 401/188 A
6,102,601 A * 8/2000 Hu ..... 401/188 A

* cited by examiner

*Primary Examiner*—David J. Walczak
(74) *Attorney, Agent, or Firm*—Varndell & Varndell, PLLC

(57) ABSTRACT

A correction pen with a pressure adjusting structure having an increased interior pressure of the pen so that the correction liquid may flow out of the pen successfully. The correction pen comprises a pen tube, a penpoint seat, and a ventilating ring. The ventilating ring is installed at an end portion of the pen tube. The lower edge thereof extends to the pen tube, and the penpoint seat is inserted into an end portion of the pen tube. The tightening portion at the lower end of the ventilating ring encloses the periphery of the penpoint seat. Thereby, a pressure adjusting structure with the ventilating ring is formed so that air flows unidirectionally, and thus a correction pen with a pressure adjusting structure is formed.

6 Claims, 8 Drawing Sheets

CORRECTION PEN WITH PRESSURE ADJUSTING STRUCTURE

FIELD OF THE INVENTION

The present invention relates to a correction pen with a pressure adjusting structure, and particularly to a correction pen with correction liquid therein; wherein a pressure adjusting structure is formed at a front end or rear end thereof. Thereby, by the pressure increasing of the ventilating ring and the penpoint cover, a positive pressure is formed in the correction pen so that correction liquid may flow out successfully.

BACKGROUND OF THE INVENTION

In the conventional correction pens, the correction liquid is filled in a soft container or a hard container. For the correction pen with a soft container, white correction liquid is filled in a soft container, and a penpoint seat is formed at an opening of the container. A center of the penpoint seat is installed with a flow path. The penpoint may touch the place to be coated. At the same time, as the penpoint reduces inwards, the soft container is pressed and thus the correction liquid is extruded out. The prior correction pen with a hard container has a structure like that with a soft container except that a positive pressure is formed in the container. Thereby, as the penpoint touches the place to be coated with correction liquid, by the positive pressure, the correction liquid can be extruded out automatically. As a result, the user is unnecessary to extrude the container (in fact, the user can not extrude it). However, when the correction pen is used through a time period, the positive pressure in the pen will disappear gradually so that a negative pressure is formed in the pen. Consequently, the correction liquid can not be extruded out automatically, and thus the correction liquid flows out intermittently.

SUMMARY OF THE INVENTION

Accordingly, the primary object of the present invention is to provide a correction pen with a pressure adjusting structure, wherein the interior of the penpoint cover or the rear end of the pen tube is formed with a soft and elastic ventilating ring. The lower end of the ventilating ring reduces inwards so as to seal the penpoint seat at the front end of the correction pen or the penpoint cover at the rear end so as to form a unidirectional pressure adjusting structure. Thereby, as the pen cover presses downwards, air can be extruded into the pen, and thus the pressure in the correction pen is larger than the outer pressure. As a result, correction liquid can be extruded successfully.

Another object of the present invention is to provide a correction pen with a pressure adjusting structure, a ventilating ring serves to confine the penpoint seat and the pen tail cover, and the lateral sides of the penpoint seat and the pen tail cover are formed with a plurality of ventilating grooves. Thereby, air is extruded out by the pen cover to pass through the ventilating grooves into the pen tube so as to increase the pressure of the correction pen. Thereby, the correction liquid may flow out from the penpoint successfully.

A further object of the present invention is to provide a correction pen with a pressure adjusting structure, wherein the ventilating ring is installed at a front end of the pen tube; the lower edge thereof extends to the pen tube, and the penpoint seat is placed at the front end of the pen tube. The tightening portion at the lower end of the ventilating ring encloses the periphery of the penpoint seat. Thereby, a pressure adjusting structure with the ventilating ring is formed so that air flows unidirectionally is formed and thus a correction pen with a pressure adjusting structure is formed.

To achieve above objects, the present invention provides a correction pen with a pressure adjusting structure, In this correction pen, interior pressure of the pen is increased so that the correction liquid may flow out successfully. The correction pen comprises a pen tube, a penpoint seat, and a ventilating ring. The ventilating ring is installed at one end portion of the pen tube. The lower edge thereof extends to the pen tube, and the penpoint seat is inserted into an end portion of the pen tube. The tightening portion at the lower end of the ventilating ring encloses the periphery of the penpoint seat. Thereby, an pressure adjusting structure with the ventilating ring is formed so that air flows unidirectionally, and thus a correction pen with a pressure adjusting structure is formed.

The various objects and advantages of the present invention will be more readily understood from the following detailed description when read in conjunction with the appended drawing.

DETAILED DESCRIPTION OF THE PREFERRED EMBODIMENTS

Figure 1:
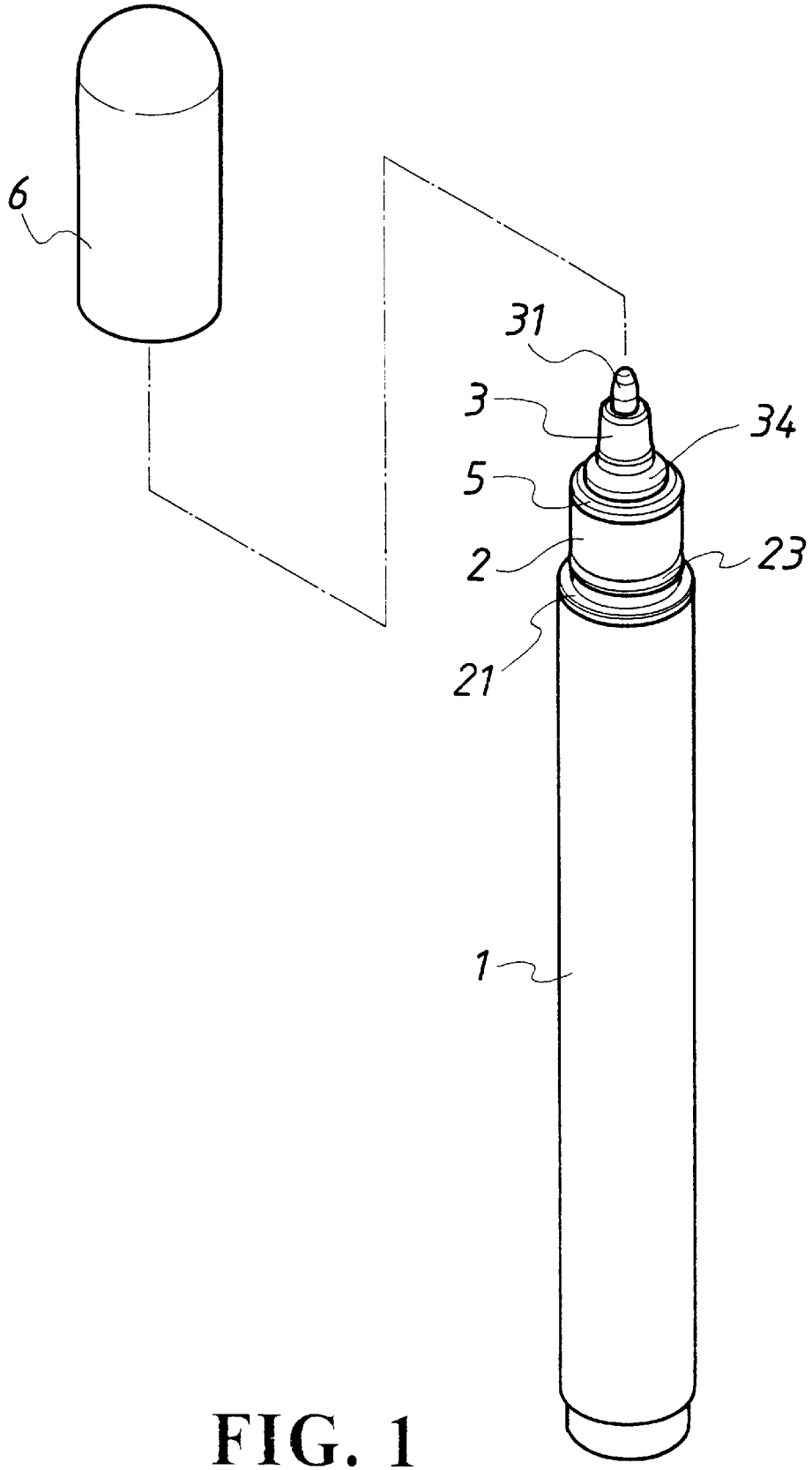
FIG. 1 is a perspective view showing the correction pen of the present invention.

The present invention relates to a correction pen with a pressure adjusting structure. The correction pen includes a pen tube 1, a penpoint cover 2, a pen-point seat 3, a pen tail cover 4, a ventilating ring 5, and a pen cover 6. The penpoint cover 2 and pen tail cover 4 may be neglected as necessary.

Figure 2:
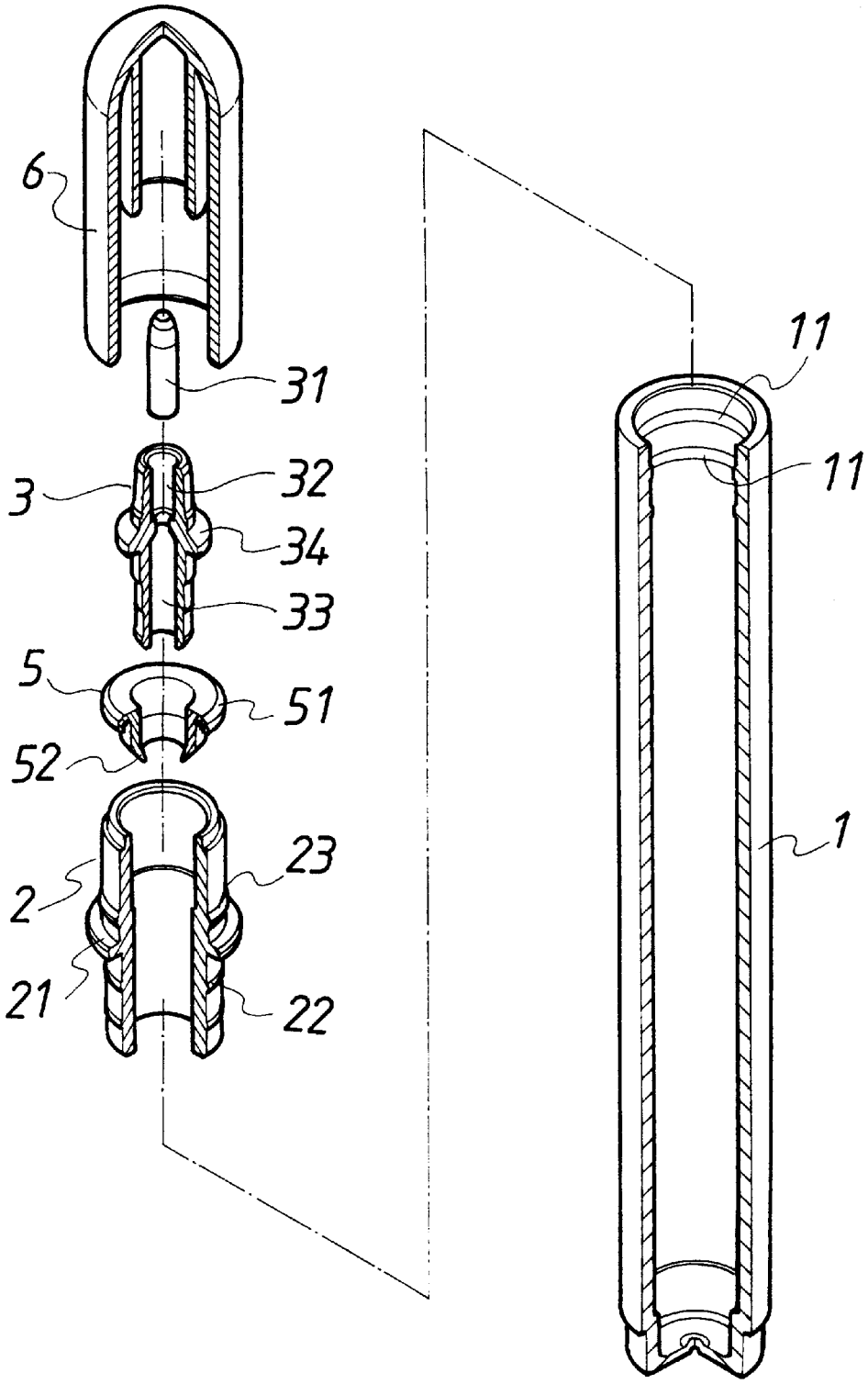
FIG. 2 is an exploded cross sectional view of the present invention.

The pen tube 1 (referring to FIG. 2) is a hollow pen tube with an opening at a front end or openings at a front end or a rear end. Thereby, connection liquid may be stored therein. The inner tube wall of the front end of the pen tube 1 is installed with one or at least one ring buckle 11.

The penpoint cover 2 may cover the front end of the pen tube 1, and is shaped like a ring. The penpoint seat 3 can be inserted into the ring. The penpoint cover 2 is like a hollow sleeve. A flange 21 is formed at the middle outer side thereof. The lower wall of the flange 21 has at least one ring buckle 22, and the upper wall of the flange 21 is formed with another ring buckle 23. Thereby, it can be buckled with other components.

Figure 4:
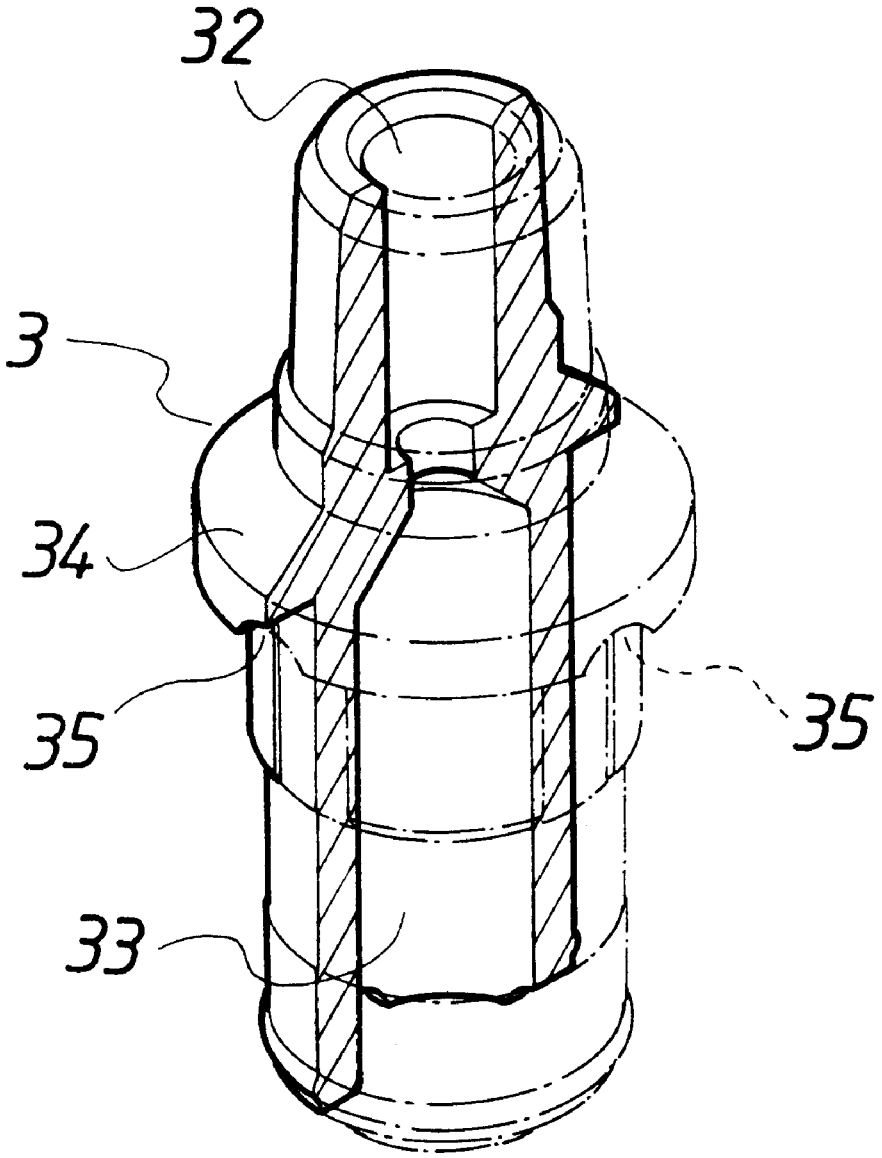
FIG. 4 is a cross sectional view of the penpoint seat of the present invention.

The penpoint seat 3 (referring to FIGS. 2 and 4) has a round taper seat which may be inserted by a pen penpoint 31 so that the correction liquid can be guided to the front end thereof. The front center of the penpoint seat 3 an inserted hole 32 for implanting a penpoint 31. The rear end thereof is installed with a through hold 33 which is communicated with the inserted hole 32. In the present invention, the middle outer side of the penpoint seat 3 is formed with a flange 34. The lower surface of the flange 34 is formed with a plurality of ventilating grooves 35 which extend to the peripheral wall of the penpoint seat 3. After assembly, the ventilating grooves 35 have the function of adjusting airflow.

The pen tail cover 4 (referring to FIG. 7) is used as a pen tube 1 with two ends thereof having openings for sealing the end of the pen tube 1. An upper end of the pen tail cover 4 has a cap 41 with a larger diameter. The lower surface of the cap 41 is selectively installed with at least one ventilating recesses 42 which extend to the lateral side of the cylinder. After assembly, the ventilating recesses 42 have the function of adjusting airflow.

The ventilating ring 5 is made of plastics and is an elastic annular ring. The upper end thereof has a flange 51, and the lower end thereof is formed with an inward extending, reduced tilt tightening portion 52. Thereby, after assembly, a unidirectional ventilating structure is formed.

The pen cover 6 is a hollow cylindrical cover with only one opening for covering the front end of the pen so as to protect the pen.

Figure 3:
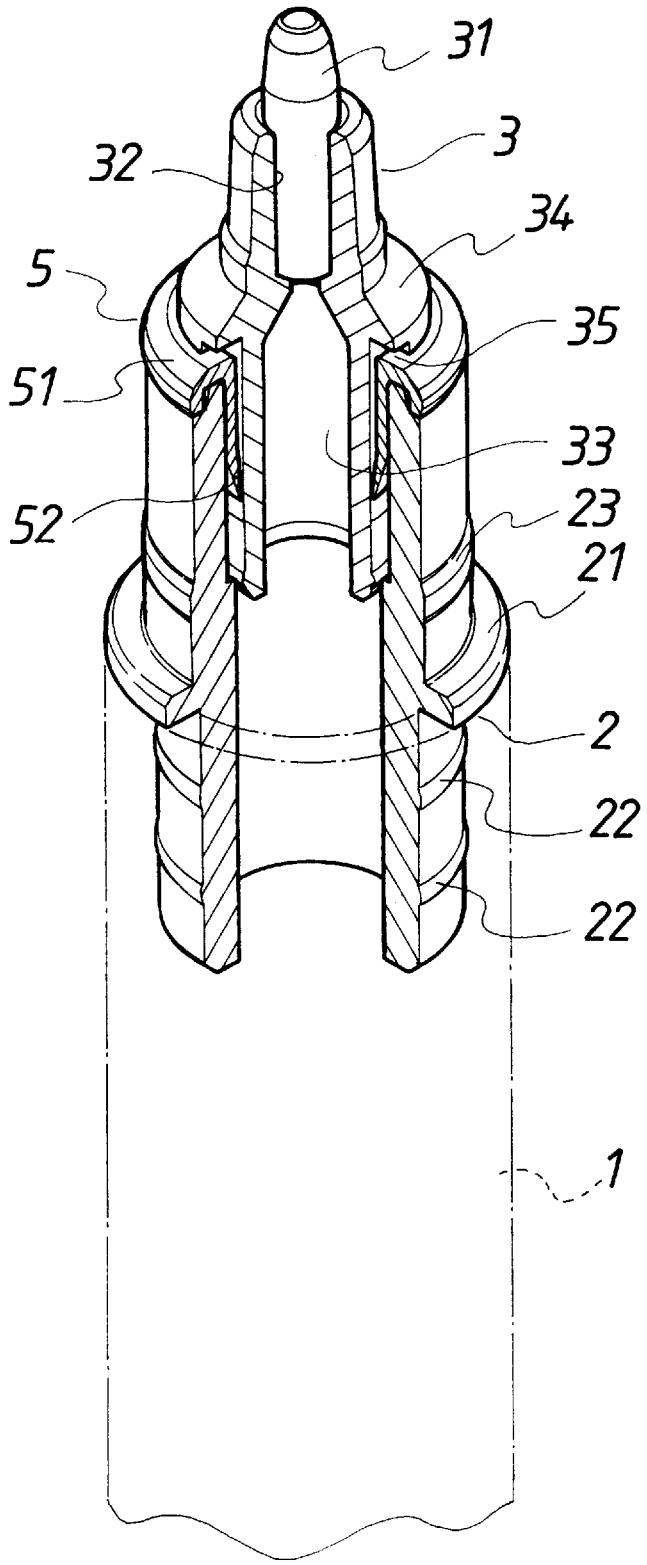
FIG. 3 is a perspective view showing that the present invention

Thereby, (referring to FIGS. 3, 5 and 6) in the present invention, a pen tube 1 with only one opening at the front end can be used. The lower section of the penpoint cover 2 is inserted into the front opening of the pen tube 1. The buckling of the ring buckles 11, 22 are buckled. The ventilating ring 5 is installed at the front interior of the penpoint cover 2 so that the flange 51 of the ventilating ring 5 runs across the front end of the penpoint cover 2. The tightening portion 52 extends thereto. Then the lower section of the penpoint seat 3 passes through the ventilating ring 5 to be inserted to the front end of the penpoint cover 2. Meanwhile, the tightening portion 52 of the ventilating ring 5 encloses the periphery of the penpoint seat 3. Thereby, by further using the ventilating grooves 35, a unidirectional pressure adjusting structure is formed. The correction pen with a pressure adjusting structure of the present invention is formed.

Figure 5:
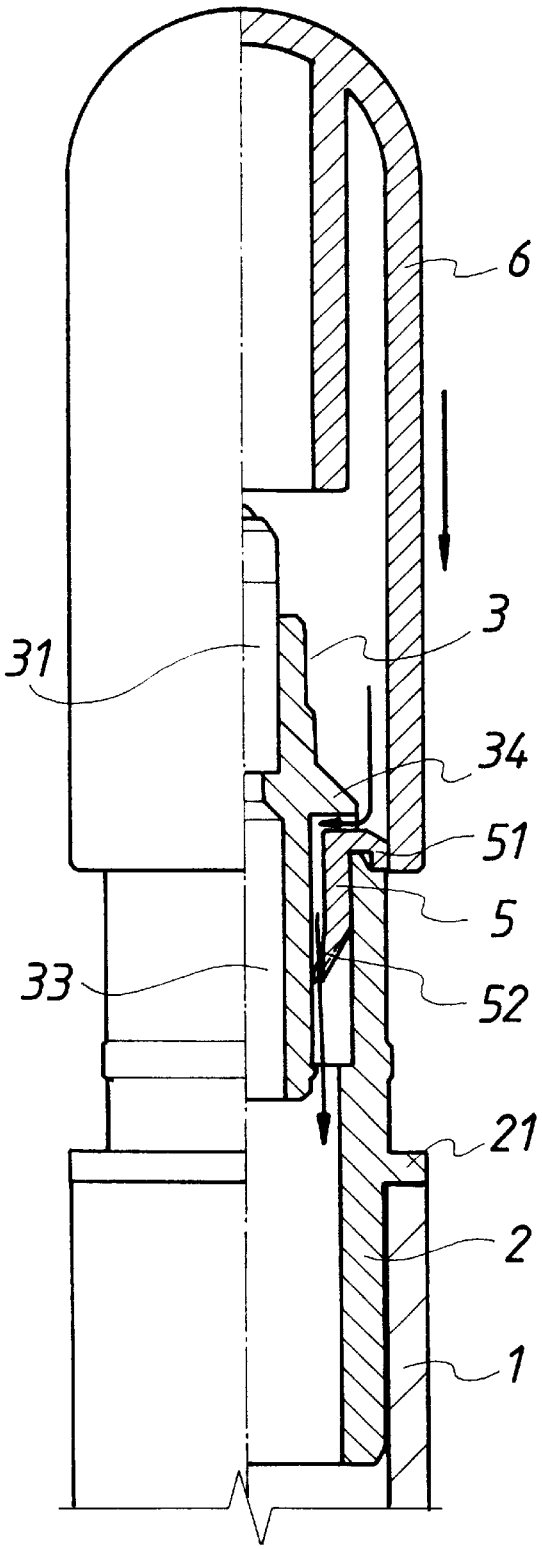
FIG. 5 is a schematic view showing the pressure increment of the correction pen of the present invention.
Figure 6:
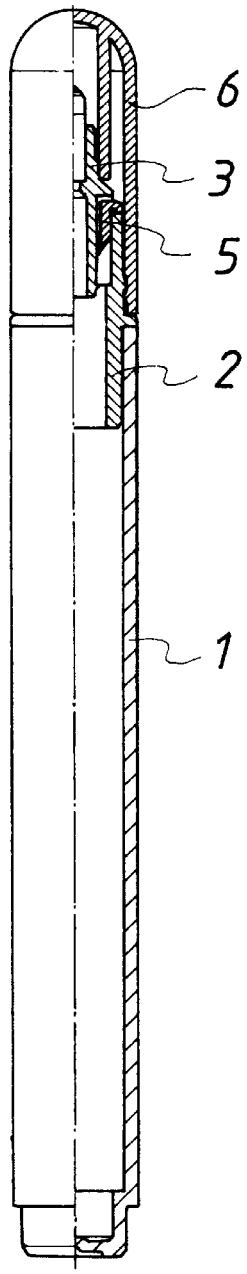
FIG. 6 is a lateral cross sectional view of the present invention which is assembled.

Referring to FIG. 5, in the present invention, the pressure within the pen cover 6 is enhanced so that the inner pressure is larger than outer pressure and the correction liquid can be extruded out successfully. Namely, by the unidirectional pressure adjusting structure formed by the ventilating ring 5, when the pen cover 6 presses downwards, the interior air within the pen cover 6 is extruded to the pen tube 1 through the ventilating ring grooves 35 and the ventilating ring 5. Thereby, the interior of the correction pen has a positive pressure, i.e., larger than outer pressure, and thus correction liquid may flow out successfully. As a result, when the pen cover 6 covers the penpoint, the interior pressure of the correction pen is increased so that sufficient correction liquid may flow to the pointpen 31 for being used next time. Moreover, since the tightening portion of the lower edge of the ventilating ring 5 encloses the periphery of the penpoint seat 3. When air does not flow into the pen tube 1, it is tightened so that no fluid flows out. Therefore, in the present invention, an effect of preventing the correction liquid from draining out is achieved.

Figure 7:
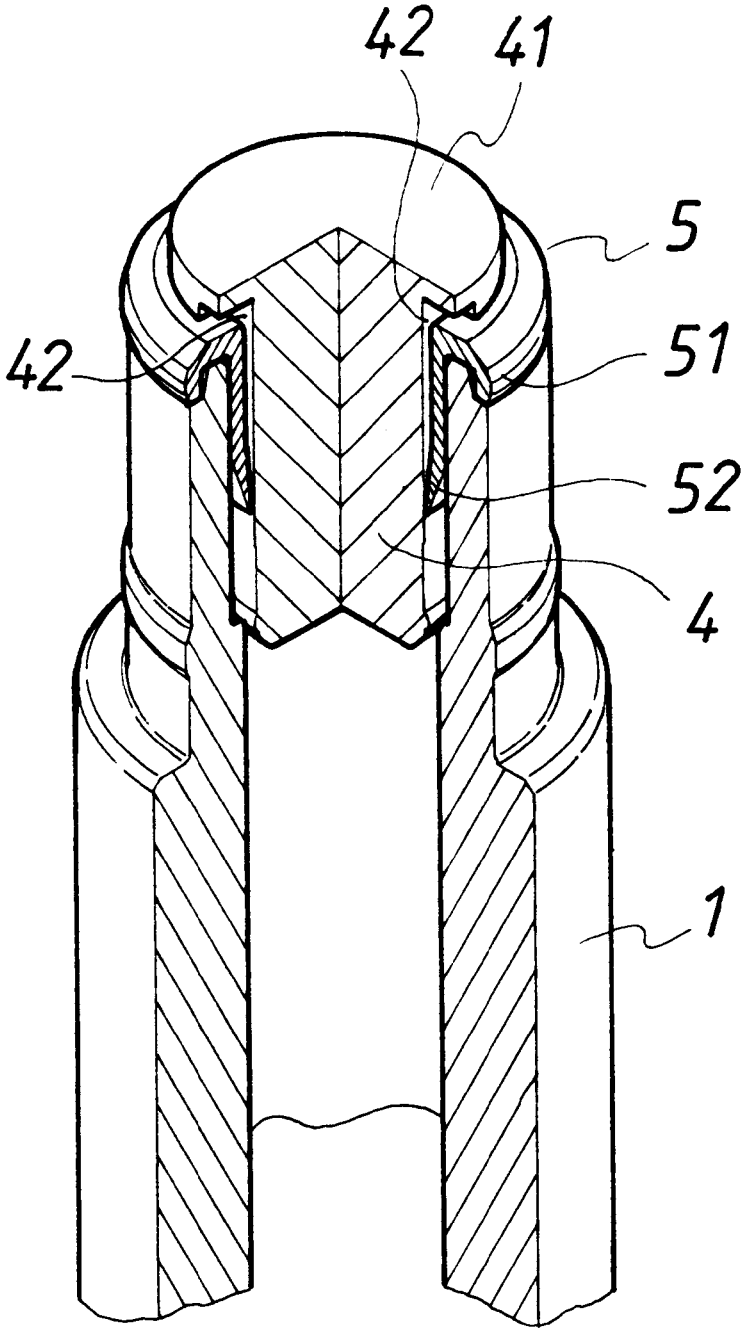
FIG. 7 is a cross sectional view showing the ventilating ring of the present invention is mounted at the rear end of the pen.
Figure 8:
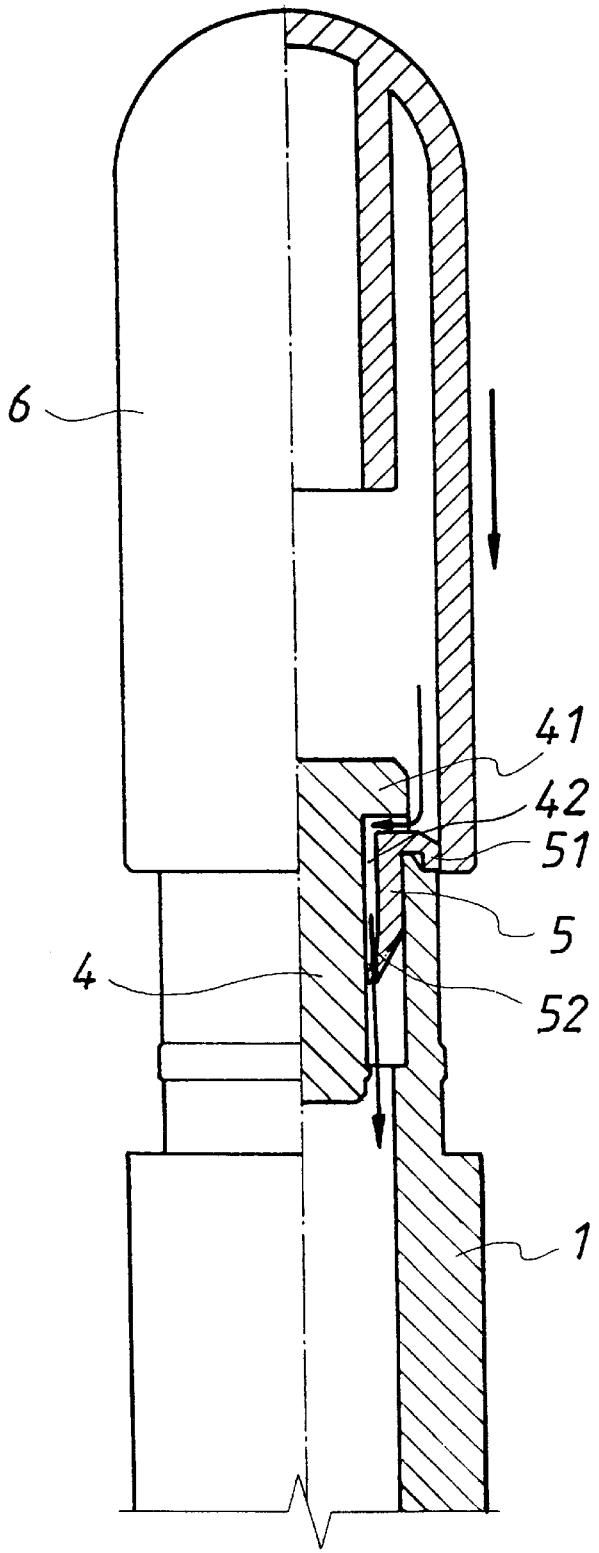
FIG. 8 is a schematic view showing that the pressure is increased as the ventilating ring is installed at a rear end.

Referring to FIGS. 7 and 8, in this embodiment, a pen tube 1 with openings at the front end and rear end is used. The ventilating ring 5 is implanted into the rear end of the pen tube 1 so that the tightening portion 52 at the lower end extends into the pen tube 1. Then the pen tail cover 4 passes through the ventilating ring 5 to seal the rear end of the pen tube 1. Then, by the matching of the ventilating recesses 42 and the ventilating ring 5, the correction pen with a pressure adjusting structure of the present invention is formed. When the pen cover 6 presses downwards, air within the pen cover 6 flows through the ventilating recesses 42 and the ventilating ring 5 into the correction pen. Thereby, the interior of the correction pen has a positive pressure larger than outer pressure. Thereby, as the penpoint 31 presses downwards, the correction liquid may be extruded out. Meanwhile, by the tightening structure of the ventilating ring 5, the correction liquid is prevented from flowing out.

Figure 9:
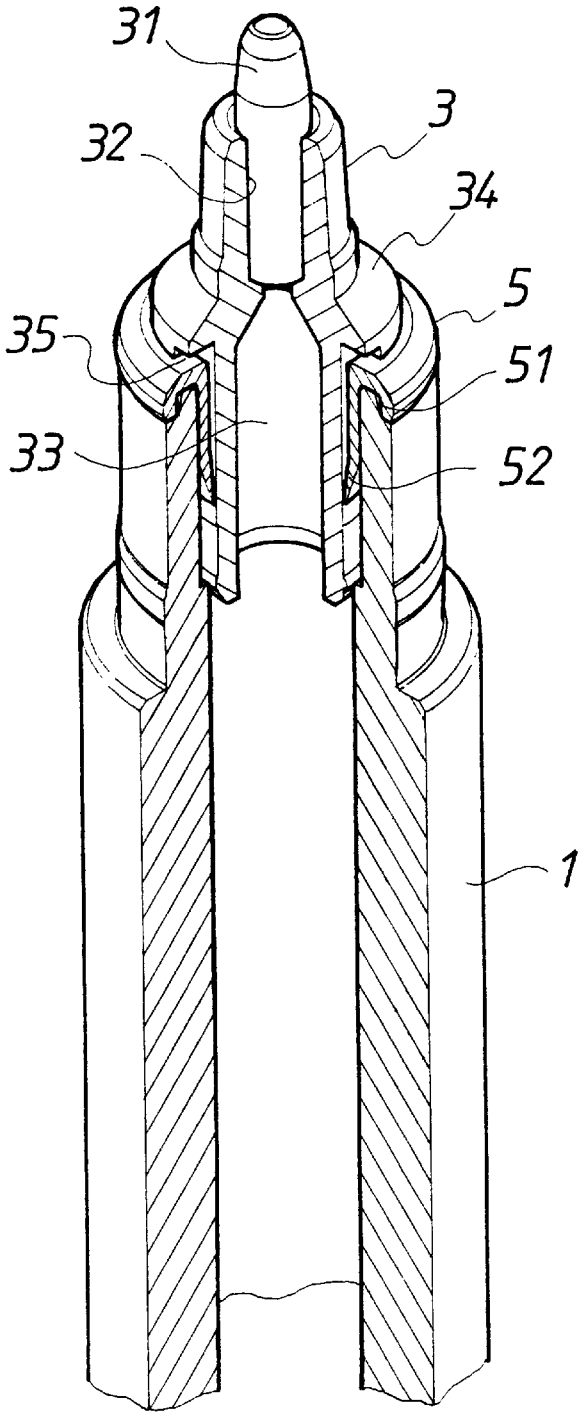
FIG. 9 is a perspective view showing another embodiment of the present invention, where the present invention is assembled.

The main technology of the present invention is that by the pressure adjusting structure of the ventilating ring 5, the pen cover 6 has the function of increasing pressure. Therefore, in the present invention, the structure and configuration of the correction pen can be modified. All these modifications are within the scope of the present invention without being confinement by above embodiments. For example, in FIG. 9, the penpoint cover 2 can be removed. Then the ventilating ring 5 is directly installed at the front end of the pen tube 1. Then the lower tightening portion 52 extends to the pen tube. Then, the penpoint seat 3 passes through the ventilating ring 5 to be in the front end of the pen tube 1. Thereby, a pressure adjusting structure is formed by matching of the ventilating grooves 35 and the ventilating ring 5. When the pen cover 6 presses downwards, the air in the pen cover 6 flows through the ventilating grooves 35 and the ventilating ring 5 into the correction pen so that the interior of the correction pen has a positive pressure which is larger than the outer air pressure. Thus, correction liquid can be extruded out successfully. Furthermore, by the tightening structure of the ventilating ring 5, the liquid is prevented from draining out.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A correction pen with a pressure adjusting structure comprising a pen tube adapted to store correction liquid therein, a penpoint, a penpoint seat, and a ventilating ring;

the pen tube comprising a hollow pen tube having an open end portion;

the penpoint seat having a front end, the penpoint being inserted into the front end of the penpoint seat and adapted for guiding a correction liquid to a round taper seat of the penpoint seat arranged at the penpoint, the penpoint seat further having a flange disposed at an outer periphery of the penpoint seat; a lower side of the flange having a plurality of ventilating grooves that extend to a peripheral wall of the penpoint seat;

the ventilating ring receiving the penpoint seat and having a round ring formed by a soft material, and a lower edge of the round ring having a reduced tilt tightening portion; and the ventilating ring being arranged at the open end portion of the pen tube; a lower edge of the ventilating ring extending toward the pen tube; the reduced tilt tightening portion of the ventilating ring enclosing a periphery of the penpoint seat, thereby forming a pressure adjusting structure with the ventilating ring so that air flows unidirectionally therethrough.

2. The correction pen with a pressure adjusting structure as claimed in claim 1, wherein a penpoint cover is interposed between the open end portion of the pen tube and the penpoint seat, the penpoint cover having a hollow cylindrical shape, the ventilating ring being installed at a front end of the penpoint cover, and the penpoint seat passing through the ventilating ring into the penpoint cover.

3. The correction pen with a pressure adjusting structure as claimed in claim 2, wherein a front end of the penpoint seat is covered by a hollow cylindrical pen cover, so that air flows into the correction pen through the ventilating ring.

4. The correction pen with a pressure adjusting structure as claimed in claim 1, wherein a front end of the penpoint seat is covered by a hollow cylindrical pen cover, so that air flows into the correction pen through the ventilating ring.

5. A correction pen with a pressure adjusting structure comprising a pen tube adapted to store correction liquid therein, a penpoint, a penpoint seat, first and second ventilating rings, and a cylindrical pen tail cover;

the pen tube comprising a hollow pen tube having front and rear ends with openings, the openings of the front and rear ends communicating with each other;

the penpoint seat having a front end, the penpoint being inserted into the front end of the penpoint seat and adapted for guiding a correction liquid to a round taper seat of the penpoint seat arranged at the penpoint; and the first and second ventilation rings having a round ring formed by a soft material, and a lower edge of the round ring having a reduced tilt tightening portion;

the first ventilating ring being arranged at the front end of the pen tube and receiving the penpoint seat; the lower edge of the first ventilating ring extending toward the pen tube, and the reduced tilt tightening portion of the first ventilating ring enclosing a periphery of the penpoint seat, thereby forming an pressure adjusting structure with the ventilating ring so that air flows unidirectionally therethrough; and the second ventilating ring being implanted into the rear end of the pen tube so that the reduced tilt tightening portion at the lower end of the second ventilating ring extends into the pen tube; the cylindrical pen tail cover passing through the second ventilating ring for sealing the rear end of the pen tube; and ventilating recesses of the cylindrical pen tail cover cooperating with the second ventilating ring to form a pressure adjusting structure.

6. The correction pen with a pressure adjusting structure as claimed in claim 5, wherein an upper end of the cylindrical pen tail cover has a cap with a larger diameter, and a lower surface of the cap is selectively installed with at least one ventilating recess extending to a lateral side of the hollow pen tube.

* * * * *